US005779465A

United States Patent [19]

Clarke et al.

[11] Patent Number: 5,779,465

[45] Date of Patent: Jul. 14, 1998

[54] SPARK IGNITED BURNER

[76] Inventors: Beresford N. Clarke, 3723 W. Hamilton Rd., Fort Wayne, Ind. 46804; John B. Clarke, 5304 Century Ct., Fort Wayne, Ind. 46807

[21] Appl. No.: 709,387

[22] Filed: Sep. 6, 1996

[51] Int. Cl.[6] ..... F24C 3/00

[52] U.S. Cl. ..... 431/8; 431/266; 431/349; 431/353; 126/91 A

[58] Field of Search ..... 431/349, 265, 431/353, 266, 8, 263, 264; 126/91 A

[56] References Cited

U.S. PATENT DOCUMENTS

| | | | |
|---|---|---|---|
| 1,835,215 | 12/1931 | Hammon | 431/349 |
| 2,073,448 | 3/1937 | Fruth et al. | 431/285 |
| 2,796,118 | 6/1957 | Parker et al. | 431/265 |
| 2,996,113 | 8/1961 | Williams . | |
| 3,007,084 | 10/1961 | Thomasian et al. . | |
| 3,032,096 | 5/1962 | Stout . | |
| 3,361,185 | 1/1968 | Anderson et al. . | |
| 3,418,060 | 12/1968 | Spielman et al. | 431/264 |
| 3,439,995 | 4/1969 | Hattori et al. | 431/266 |
| 3,529,915 | 9/1970 | Tsuji et al. | 431/284 |
| 3,685,949 | 8/1972 | Greaves | 431/349 |
| 4,431,400 | 2/1984 | Kobayashi et al. . | |
| 4,494,923 | 1/1985 | Guillaume et al. . | |
| 4,496,314 | 1/1985 | Clarke . | |
| 4,524,752 | 6/1985 | Clarke . | |
| 4,541,798 | 9/1985 | Miller et al. . | |
| 4,595,353 | 6/1986 | de Haan . | |
| 5,000,159 | 3/1991 | Clarke et al. . | |
| 5,460,515 | 10/1995 | Harbeck et al. | 431/265 |

*Primary Examiner*—Carl D. Price
*Attorney, Agent, or Firm*—Barnes & Thornburg

[57] ABSTRACT

A spark ignited burner that includes a fuel-oxidant pre-mixing chamber upstream of both an annular ignition spark discharge gap and a main fuel outlet. A continuous ignition discharge spark is established and maintained across the annular ignition spark discharge gap and used to ignite a pre-mixed fuel-oxidant mixture, which in turn is used to ignite the main burner flame.

39 Claims, 4 Drawing Sheets

SPARK IGNITED BURNER

TECHNICAL FIELD

The present invention relates generally to burner structures and more particularly to a novel spark ignited burner structure which provides for improved pre- and post-mixing of fuel-oxidant relative to the point of ignition.

BACKGROUND ART

Burners are generally divided into two types: premix and post-mix. In pre-mix burners, the fuel and oxidant are mixed prior to entering the burner nozzle. In post-mix burners the fuel and oxidant are not mixed until they are discharged into a combustion zone.

Ignition system burners generally use either a pilot light or an electrical ignition system in which an electric discharge across a gap provides a spark that ignites the fuel and oxidant mixture. Gas pilot lights are difficult to maintain because they operate at high ambient temperatures and are subject to clogging. Electrical ignition systems also present problems when the electrodes are small and subject to erosion failures. Such failures are a particular problem if the electrode components must function in a high ambient temperature location.

Examples of post-mix burners having electrical ignition are disclosed in U.S. Pat. Nos. 2,996,113, to Williams, 4,431,400 to Kobayashi et al., 4,541,798 to Miller et al., and 5,000,159 to Clarke et al.

Spark ignited burners are employed in gas fired radiant tube burners which in turn are used in various furnace designs. Among other parameters, the efficiency of such burners is evaluated based upon the uniformity at which their tubes are heated, heat recovered and reused, and the completeness of combustion. The present invention is directed to an improved spark ignited burner which optimizes the performance of gas fired radiant tube burner systems.

DISCLOSURE OF THE INVENTION

It is accordingly one object of the present invention to provide a spark ignited burner.

Another object of the present invention is to provide a spark ignited burner which ignites a pre-mixed fuel-oxidant mixture.

It is another object of the present invention to provide a spark ignited burner which utilizes a continuous electrical spark to ignite a pre-mixed fuel-oxidant mixture.

A further object of the present invention is to provide a spark ignited burner which ignites a pre-mixed fuel-oxidant mixture and utilizes the ignited pre-mixed fuel-oxidant mixture to ignite a main burner flame.

A further object of the present invention is to provide a spark ignited burner which reduces fuel consumption.

A further object of the present invention is to provide a spark ignited burner which reduces undesirable emission products.

A still further object of the present invention is to provide a spark ignited burner which can be used in conjunction with radiant tubes.

A still further object of the present invention is to provide a spark ignited burner which can be used to uniformly heat a radiant tube.

A yet further object of the present invention is to provide a method of firing a spark ignited burner.

According to these and further objects of the present invention which will become apparent as the description thereof proceeds below, the present invention provides a spark ignited burner which includes:

- a first tubular member having first and second ends;
- a second tubular member having first and second ends, the second tubular member surrounding and being coaxial with the first tubular member so as to define an annular space therebetween;
- means for introducing a fuel gas through the first tubular member;
- means for introducing a primary air flow through the annular space between the first and second tubular members; and
- a burner tip assembly attached to the second ends of the first and second tubular members, the burner tip assembly comprising:
  - a burner nozzle in fluid communication with the second end of the first tubular member;
  - a burner tip surrounding the burner nozzle and defining an annular space therebetween, the burner tip being in fluid communication with the annular space between the first and second tubular members;
  - a pre-mixing chamber defined within the annular space between the burner nozzle and the burner tip and having a first radial width; and
  - an ignition spark discharge gap defined between the burner nozzle and the burner tip and having a second radial width that is smaller than the first radial width of the pre-mixing chamber, the ignition spark discharge gap being downstream of the pre-mixing chamber.

The present invention further provides a spark ignited burner which includes:

- a first tubular member having first and second ends;
- a second tubular member having first and second ends, the second tubular member surrounding and being coaxial with the first tubular member so as to define an annular space therebetween;
- means for introducing a fuel gas through the first tubular member;
- means for introducing a primary air flow through the annular space between the first and second tubular members; and
- a burner tip assembly attached to the second ends of the first and second tubular members, the burner tip assembly comprising:
  - a burner nozzle in fluid communication with the second end of the first tubular member; and
  - a burner tip surrounding the burner nozzle and defining an annular space therebetween, the burner tip being in fluid communication with the first tubular member and having a radially inward directed structure which defines an annular ignition spark discharge gap between the burner nozzle and the burner tip.

The present invention also provides a method of firing a spark ignited burner having concentric, coaxial gas inlet and air inlet tubes, which method involves:

- providing a burner tip assembly at adjacent ends of the gas inlet and air inlet tubes, the burner tip assembly having an annular ignition spark discharge gap at an end thereof;
- applying a sufficient electrical potential across the annular ignition spark discharge gap to generate an ignition spark across the annular ignition spark discharge gap;

discharging a fuel-air mixture through the annular ignition spark discharge gap so as to cause the fuel-air mixture to become ignited;

discharging a fuel gas though an orifice attached to the gas inlet tube, the orifice having a discharge opening which is radially aligned with the annular ignition spark discharge gap; and igniting the discharged fuel gas with the ignited fuel-air mixture.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to spark ignited burners that can be used in essentially any application where a gaseous fuel is burned. However, the spark ignited burner of the present invention is particularly useful in gas fired radiant tube furnaces, because of its unique ability to produce a long diffusion-type flame which can be used to uniformly heat a radiant tube.

The spark ignited burner of the present invention utilizes a plasma-type ignition system which incorporates a continuous spark that provides a high energy ignition. The burner provides for a small amount of air-gas pre-mix at the exact point of ignition which ignites a primary gas stream which in turn ignites the main burner raw gas stream. The continuous spark is maintained by applying an electrical potential across the primary air and gas inlet tubes at a narrow annular gap between the outlet ends of the primary air and gas inlet tubes. In operation, the continuous spark established and maintained across the annular gap moves randomly around the annular gap. The annular spark gap provides a large electrode area at which the ignition spark can be established and maintained, thus extending the service life of the burner.

When used in conjunction with a gas fired radiant tube furnace, the ignited main burner raw gas stream flows centrally through a radiant tube, and is surrounded by an annular stream of preheated combustion air, flowing at a matching velocity. This produces a long diffusion-type flame which uniformly heats the radiant tube.

The annular stream of preheated combustion air which surrounds the ignited main burner raw gas stream is axially directed as it leaves the burner so as to reduce turbulence, and thus produce a long uniform flame which extends throughout the radiant tube. The low turbulence-low temperature flame transfers energy with high efficiency while reducing potentially polluting oxides of nitrogen in the exhaust gas stream. Carbon monoxide emissions can be lowered by 20 to 40 percent or more utilizing the burner of the present invention, and fuel consumption can be reduced by 35 to 50 percent.

Figure 1:
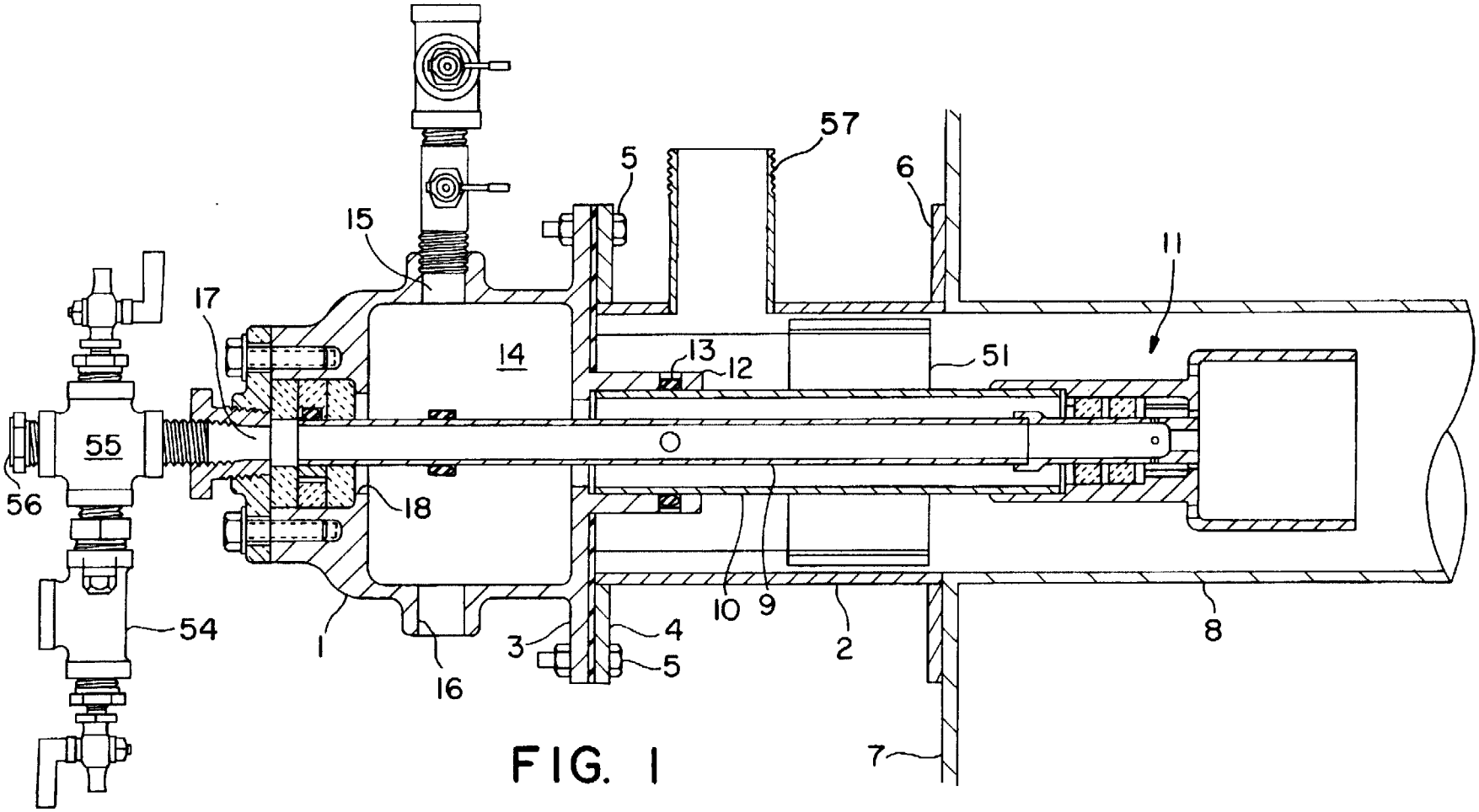
FIG. 1 is a schematic longitudinal cross-sectional view of a burner according to the present invention installed in a radiant tube furnace.

FIG. 1 is a schematic longitudinal cross-sectional view of a burner according to the present invention installed in a radiant tube furnace. The burner has a housing assembly which includes burner housing 1 and air inlet housing 2. As shown in FIG. 1, the burner housing 1 and air inlet housing 2 are secured together at respective flanges 3 and 4 by suitable mechanical fasteners 5. The air inlet housing 2 is likewise provided with a flange 6 or other suitable connector by which it can be attached to a furnace 7 at an opening of a radiant tube 8 in a known manner. The radiant tube 8 may be U-shaped, M-shaped, or have any other suitable shape. In addition, the radiant tube 8 can be a pressure tube, a negative pressure tube, or an electrified tube.

The basic elements of the burner include the gas inlet tube 9, the primary air tube 10, and the burner tip assembly 11. The gas inlet tube 9 and the primary air tube 10 are supported by the burner housing 1 so as to be coaxial and concentric as depicted. The primary air tube 10 extends outwardly from the front of the burner housing 1 as depicted in FIG. 1. Suitable means for attaching primary air tube 10 to the front of burner housing 1 may include a collar 12 into which primary air tube 10 can be inserted and a plurality of set screws 13 which can be tightened to secure primary air tube 10 in collar 12. Other equivalent mechanical means may be used to attach the primary air tube 10 to the front of burner housing 1, such as a threaded collar and cooperating threads on the primary air tube.

The primary air tube 10 is in fluid communication with primary air chamber 14. Air is introduced into air chamber 14 through primary air inlet 15. As shown in FIG. 1, air flow regulating valves, including a shutoff valve can be connected to primary air inlet 15. In FIG. 1, port 16 is provided in burner housing 1 to gain access to primary air chamber 14. Port 16 is plugged during operation of the burner.

The gas inlet tube 9 extends through the burner housing 1 and outwardly beyond the front face of the burner housing 1 coaxially with primary air tube 10. The gas inlet tube 9 is in fluid communication with a gas inlet 17 to which is connected suitable control valves as discussed in more detail below.

Figure 2:
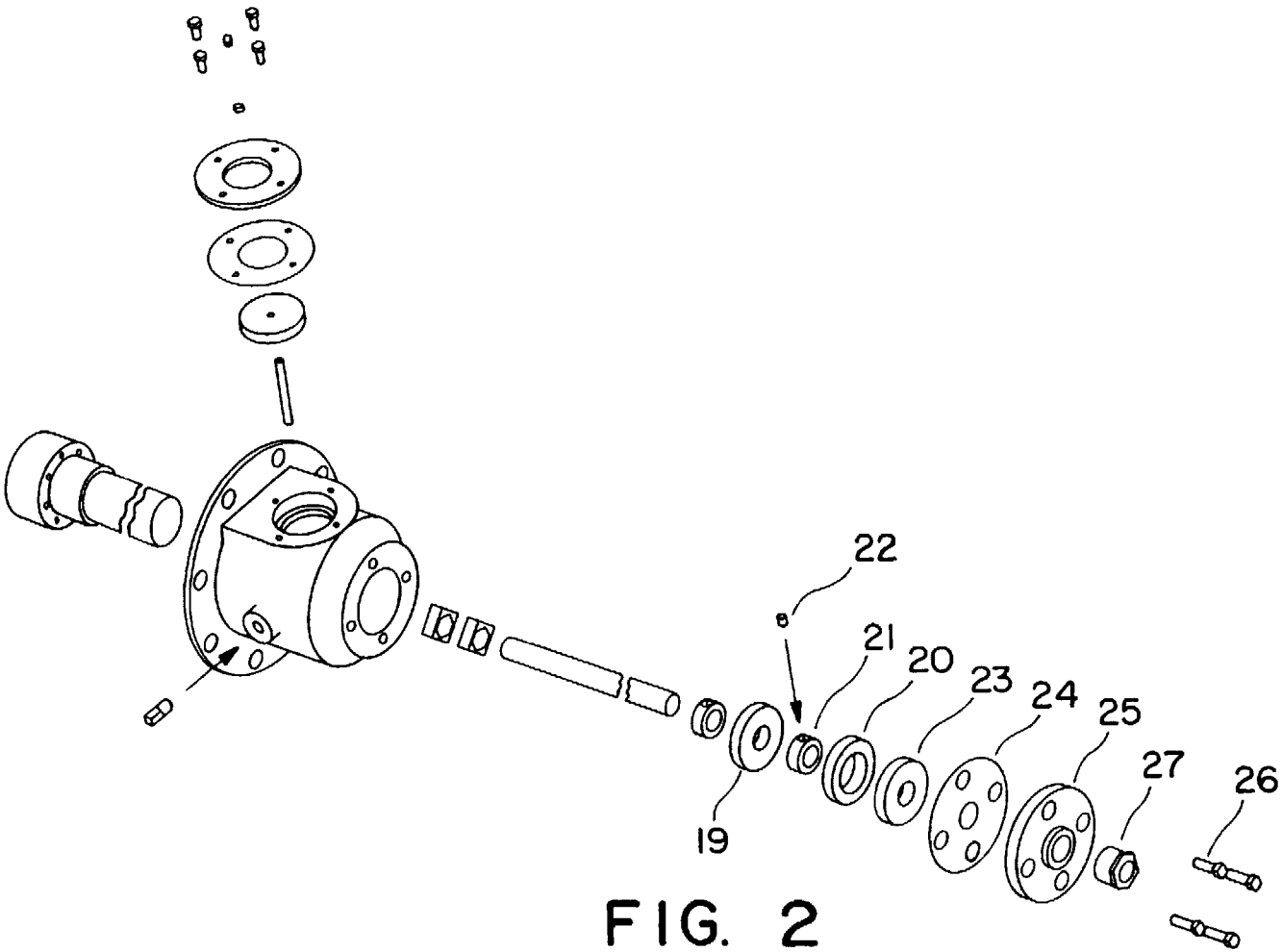
FIG. 2 is an exploded view of the burner housing and gas inlet tube of FIG. 1.

In operation, an electric potential is applied to the gas inlet tube 9. Accordingly, the gas inlet tube 9 is insulated from the burner housing 1. This is accomplished by securing the end of gas inlet tube 9 in the burner housing 1 by means of insulator elements. FIG. 2 is an exploded view of the burner housing 1 which depicts one manner by which the gas inlet tube 9 can be attached thereto. As shown in FIG. 1 the rear portion of the burner housing 1 includes a stepped through-bore 18. Through-bore 18 receives a set of ring-shaped insulating elements including first, second and third insulating elements. The first insulating element 19 has an outer diameter slightly smaller than the inner diameter of the through-bore, and a central hole which is slightly larger than the outer diameter of the gas inlet tube 9. The first insulating element 19 abuts the stepped portion of through-bore 18 as shown in FIG. 1.

The second insulating element 20 has the same outer diameter as the first insulating element 19. However, the central hole in the second insulating element 20 is sized so as to receive a set collar 21 which is slid over gas inlet tube 9 and secured in position at or near the end of the gas inlet tube 9 by one or more set screws 22 (one shown).

The third insulating element 23 is of the same size as the first insulating element 19.

The gas inlet tube 9 is attached to burner housing 1 by fixing set collar 21 at or near the end of the gas inlet tube 9, sandwiching the set collar between the first and third insulating elements 19 and 23 with the second insulating element 20 positioned over set collar 21, and positioning the assembly into through-bore 18. Next, gasket 24 (FIG. 2) and flange 25 are used to secure the insulator/set collar assembly in through-bore 18. Suitable mechanical fasteners such as bolts 26 can be used to secure flange 25 in position. Bushing 27 is received in gas inlet 17 and can be attached to a bore in flange 25 by screw threads.

The opposite or front ends of the gas inlet and primary inlet tubes 9 and 10 are unsupported by the radiant tube 8 into which they are inserted when the burner is attached to furnace 7. A burner tip assembly 11 is attached to the ends of the gas inlet tube 9 and the primary air tube 10. The burner tip assembly 11 shown in FIG. 3 includes a burner nozzle 28 which is attached to the front end of the gas inlet tube 9, and a burner tip 29 which is attached to the front end of the primary air tube 10.

Figure 4:
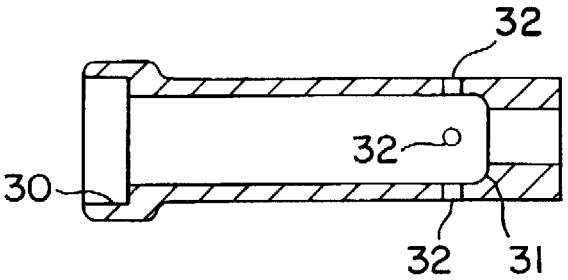
FIG. 4 is a cross-sectional view of the burner nozzle of FIG. 3.

FIG. 4 is a cross-sectional view of the burner nozzle 28. The burner nozzle 28 is made from a high temperature resistant alloy such as stainless steel, and includes a shallow stepped bore 30 by which it can be attached to the gas inlet tube 9. As shown in FIG. 1, the inner and outer diameters of the burner nozzle 28 are substantially the same as the inner and outer diameters of the inlet tube 9 except for a restrictive orifice 31 provided at the tip of the burner nozzle 28. This restrictive orifice 31 is provided to create a back pressure which forces a portion of the fuel gas to flow outward through a plurality of openings 32 provided in the wall of the burner nozzle 28 adjacent restrictive orifice 31.

Figure 5B:
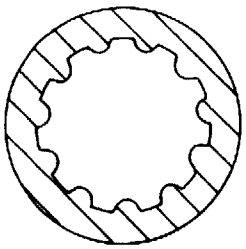
FIG. 5*b* is a radial cross-sectional view of the mixing chamber of FIG. 5*a*.
Figure 3:
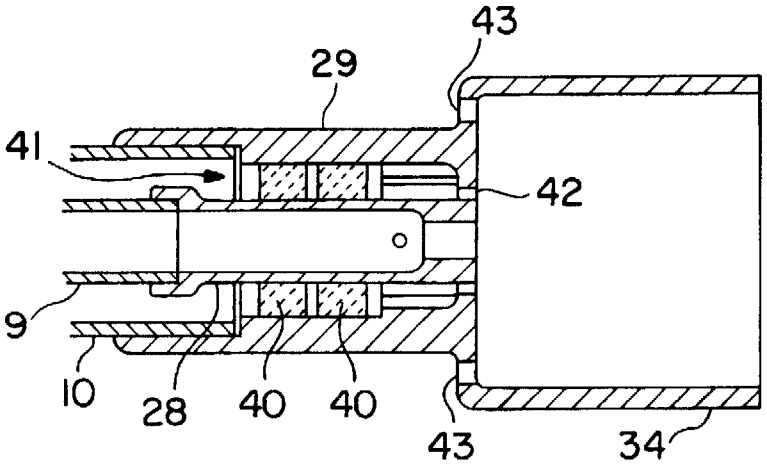
FIG. 3 is an enlarged cross-sectional view of the burner tip assembly of FIG. 1.
Figure 5A:
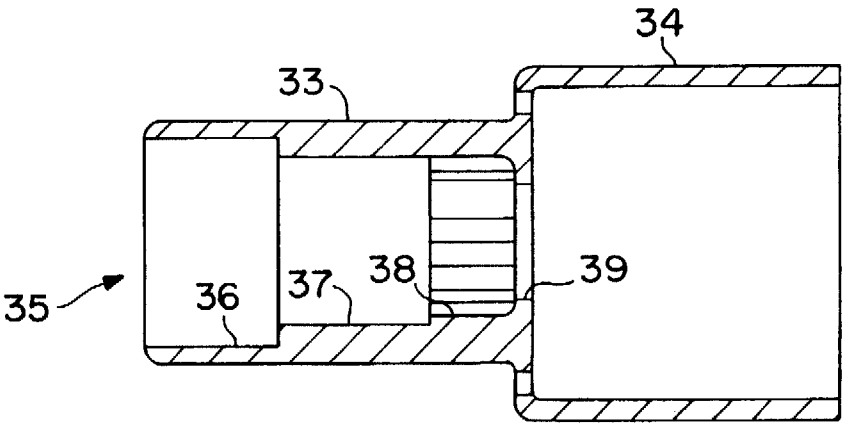
FIG. 5*a* is a cross-sectional view of the burner tip of FIG. 3.

FIG. 5*a* is a cross-sectional view of the burner tip 29. As shown, the burner tip 29 includes a main body portion 33 and a flame retention cup 34 which extends from the front portion of the main body portion 33. The main body portion 33 of the burner tip 29 includes a multiple stepped bore 35, having first 36, second 37, third 38, and fourth 39 stepped portions of progressively smaller diameters. The first stepped portion 36 of bore 35 is dimensioned to receive the front end of primary air tube 10 as shown in FIG. 1. The second stepped portion 37 is dimensioned to receive ceramic spacers 40 (see FIG. 3) which maintain the alignment of the burner assembly 11 and electrically insulate the gas inlet tube 9 from the primary air tube 10 and other elements of the burner tip assembly 11. The ceramic spacers 40 preferably have a square cross-sectional shape and diagonal dimensions which are slightly smaller that the inner diameter of the second stepped bore portion 37. This ensures that the ceramic spacers 40 do not block the flow of primary air through the annular space 41 between the burner nozzle 28 and the burner tip 29 (FIG. 3). The ceramic spacers 40 may have other non-circular cross-sectional shapes including triangular, and other polygonal and non-polygonal shapes so long as they do not completely block the flow of primary air through the annular space 41 between the burner nozzle 28 and the burner tip 29. Each of the ceramic spacers 40 includes a centrally located through-hole having an inner diameter which is slightly larger than the outside diameter of the burner nozzle 28. The burner nozzle 28 is received in these through-holes as depicted in FIGS. 1 and 3.

The third stepped bore portion 38, defines a pre-mixing chamber 42 into which fuel gas passing through openings 32 of the burner nozzle 28 mixes with the primary air flow. As depicted in FIG. 5*b*, the third stepped bore portion 28 can be defined by fluted or grooved structures which ensure that the ceramic spacers 40 do not significantly block the flow of gases through annular space 41. In addition, the fluted or grooved structure assists in more efficient mixing of the primary air and fuel gas passing through openings 32.

The fourth stepped bore portion 39 has an inner diameter which is sized to form an annular or ignition spark discharge gap 42 between the distal end of burner nozzle 28 and the front end of burner tip 29. It is across this gap 42 that an ignition spark is generated and maintained when an electric potential is applied to the gas inlet tube 9 and the primary air tube 10 is grounded. In operation, the ignition spark moves randomly around annular gap 42.

Flame retention cup 35 extends from the front end of the burner tip 29 in both radial and longitudinal directions, and includes a plurality of openings 43 adjacent the end of the burner tip 29 through which a portion of the main combustion air stream can enter the flame retention cup 34 and mix with the main gas stream exiting restrictive orifice 31.

Figure 6:
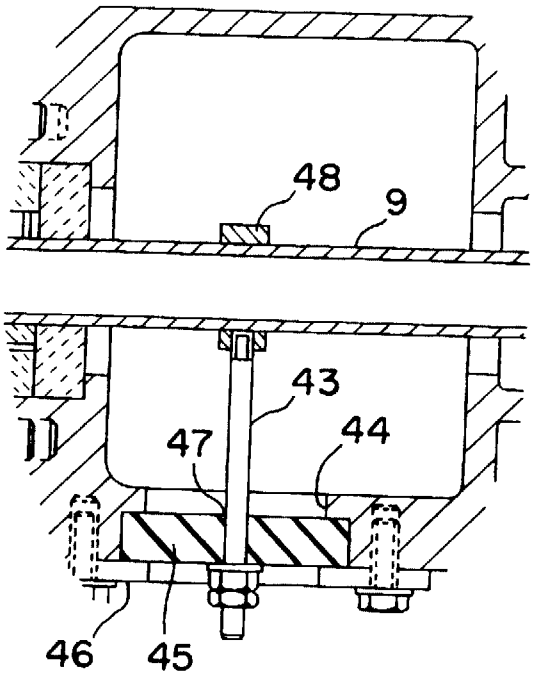
FIG. 6 is a schematic cross-sectional diagram of the ignition rod assembly.

FIG. 6 is a schematic cross-sectional diagram of the ignition rod assembly. In order to apply an electric potential to the gas inlet tube 9, an electrode or ignition rod 43 is connected to the gas inlet tube 9. This is done by providing a stepped bore 44 in one side of the burner housing 1. For example, in FIG. 1 the stepped bore 44 would have an axis which would extend out of the page. An insulator 45 is received in stepped bore 44 and secured therein by a retaining flange 46 which is attached by mechanical fasteners to the burner housing 1. The insulator 45 includes a through-hole 47 through which the electrode or ignition rod 43 extends. The electrode or ignition rod 43 is attached to the outer surface of gas inlet tube 9 by a set collar 48 which is secured to the gas inlet tube 9 by one or more set screws (not shown) and/or by providing threads on the end of the electrode or ignition rod 43 and screwing the threaded end thereof into set collar 48.

The end of electrode or ignition rod 43 which extends out through insulator 45 is secured against the insulator 45 by means of mechanical fasteners, such as brass nuts 49 and washer 50.

Figure 7A:
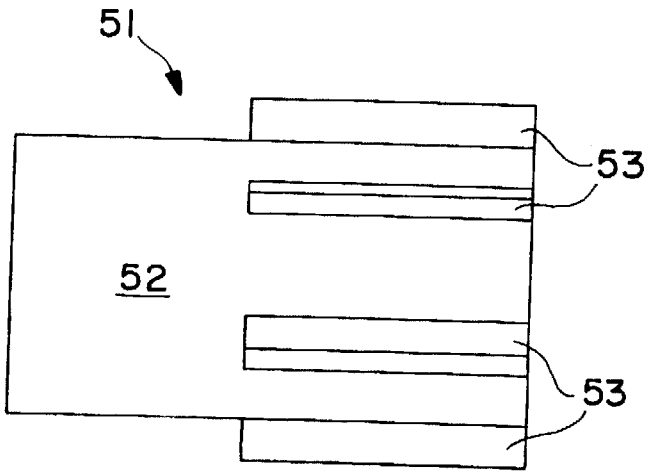
FIG. 7*a* is a side view of an air shroud.
Figure 7B:
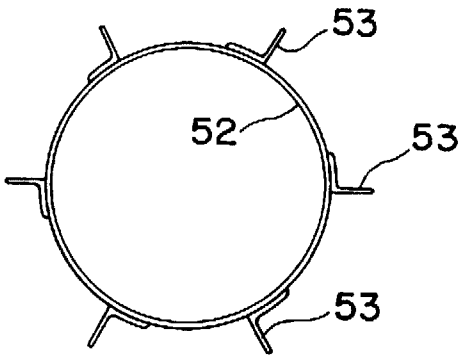
FIG. 7*b* is an end view of the air shroud of FIG. 7*a*.

An air shroud 51 is provided in the air inlet housing 2 in the annular space between the primary air inlet tube 10 and the wall of the air inlet housing 2. The air shroud 51 shown in FIGS. 7*a* and 7*b* includes a cylindrical body portion 52 and a plurality of fins or ribs 53 which extend axially along a portion of the outer surface of the cylindrical body portion 52. In a preferred embodiment, the ratio of the height of the fins or ribs 53 to the diameter of the cylindrical body portion 52 is about 0.18 to 0.44. The air shroud 51 diverts and directs the flow of the main combustion air entering the air inlet housing 2 so that the air, which enters the housing in a radial direction, is evenly distributed about the primary air tube 10 and directed axially along the primary air tube 10 as it exits the air inlet housing 2. Preferably, the air flow exits the air inlet housing in a laminar flow pattern. This ensures that the main gas flame generated in the flame retention cup 34 extends within the surrounding annular air flow along the length of the radiant tube 8, so as to effect complete combustion of the fuel gas and thereby minimize undesirable combustion products.

In a preferred embodiment, the fuel gas enters the burner housing 1 through a gas supply line (not shown) which is connected to metering orifice 54. This metering orifice 54 is connected to a fitting 55 which includes a sight glass 56 that allows visual and instrumental (e.g. ultra violet) observation of the main burner flame though the central axis of the gas inlet tube 9.

In operation, primary air flow is established by introducing air into primary air chamber 14 via primary air inlet 15. Fuel gas is introduced into gas inlet tube 9 through inlet 17. Prior to the introduction of fuel gas, an ignition spark is generated and maintained between the gas inlet tube 9 and the primary air tube 10 across ignition spark discharge gap 42 by applying an electric potential on the order of between 6,000 and 10,000 volts to the igniter rod 43. Air and fuel gas which are pre-mixed in the pre-mixing chamber defined by the third stepped bore position 38 are ignited as they pass through gap 42 and encounter the ignition spark. This ignited air-fuel gas mixture in turn ignites the main gas flow which enters the flame retention cup 34 from the burner nozzle 28. At this stage, a portion of the main combustion air flow introduced though the inlet 57 of the combustion air housing 2 mixes with the fuel gas in the main gas flame (in flame retention cup 34) and flows past flame retention cup 34 and through the radiant tube 8 together with the main gas flame which it surrounds.

The length of the main gas flame is controlled by adjusting the primary to main combustion air flow ratios. Such adjustment allows the burner assembly to obtain optimum tube temperature over a wide range of firing rates and preheated air temperatures. Generally, at least the main combustion air is heated by a recuperator which recovers heat from the exhaust end of the radiant tube in a known manner. Preheated air temperatures of up to 650° C. or greater can be used with the burner assembly of the present invention. Stability can be maintained and flame length can be controlled with firing rates of as little as 80,000 BTU/Hr input to as much as 700,000 BTU/Hr.

The burner assembly of the present invention can produce an extremely stable flame and luminous envelope profile that maximizes heat release throughout the radiant tube. This effect reduces thermal stress on the radiant tube which can occur during uneven heating. The use of a continuous ignition spark ensures instant ignition of the fuel gas during pulsed fuel gas operation and thus uniform heating of the radiant tube. Because of its ability to provide uniform heating, it has been determined that the burner assembly of the present invention can be used in conjunction with radiant tubes which are made of materials such as ceramics which cannot tolerate thermal stresses.

The use of a continuous ignition spark allows the burner assembly to operate from the Duration Adjustment Type (DAT) output from a Proportional, Derivative, Integral (PID) control loop. When properly controlled, tube temperature variations as low as ±4° F. have been achieved. The burner assembly of the present invention can be operated with proportional control over the entire firing rate range, in a high-low mode, an on-off mode or a pulse-fired mode, which is preferred because temperature control is optimized.

The burner assembly is preferably constructed of cast iron and carbon steel, with the high temperature components being constructed of stainless steel. The insulator elements are made from electrically insulative ceramic materials.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A method of firing a spark ignited burner having concentric, coaxial gas inlet and air inlet tubes, which method comprises:

providing a burner tip assembly at adjacent ends of the gas inlet and air inlet tubes, the burner tip assembly having an annular ignition spark discharge gap at an end thereof;

applying a sufficient electrical potential across the annular ignition spark discharge gap to generate an ignition spark across the annular ignition spark discharge gap;

discharging a fuel-air mixture through the annular ignition spark discharge gap so as to cause the fuel-air mixture to become ignited;

discharging a fuel gas though an orifice attached to the gas inlet tube, the orifice having a discharge opening which is radially aligned with the annular ignition spark discharge gap; and igniting the discharged fuel gas with the ignited fuel-air mixture.

2. The method of firing a spark ignited burner according to claim 1, wherein the electrical potential is applied across the annular ignition spark discharge gap to maintain an ignition spark across the annular ignition spark discharge gap.

3. The method of firing a spark ignited burner according to claim 1, further comprising:

surrounding the ignited fuel gas with a flame retention cup.

4. The method of firing a spark ignited burner according to claim 2, which further comprises:

inserting the burner tip assembly into a radiant tube.

5. The method of firing a spark ignited burner according to claim 3, which fur the comprises:

directing a flow of air through the radiant tube and around the burner tip assembly.

6. A spark ignited burner which comprises:

a first tubular member having first and second ends;

a second tubular member having first and second ends, the second tubular member surrounding and being coaxial with the first tubular member so as to define an annular space therebetween;

means for introducing a fuel gas through the first tubular member;

means for introducing a primary air flow through the annular space between the first and second tubular members; and a burner tip assembly attached to the second ends of the first and second tubular members, the burner tip assembly comprising:

a burner nozzle in fluid communication with the second end of the first tubular member;

a burner tip surrounding the burner nozzle and defining an annular space therebetween, the burner tip being in fluid communication with the annular space between the first and second tubular members;

a pre-mixing chamber defined within the annular space between the burner nozzle and the burner tip and having a first radial width; and an annular ignition spark discharge gap defined between the burner nozzle and the burner tip and having a second radial width that is smaller than the first radial width of the pre-mixing chamber, the annular ignition spark discharge gap being downstream of the pre-mixing chamber.

7. The spark ignited burner of claim 1, wherein the annular ignition spark discharge gap is defined in part by surfaces of the burner nozzle and the burner tip which lie within a common plane that is perpendicular to an axis of the first and second tubular members.

8. The spark ignited burner of claim 1, wherein the burner nozzle includes a restrictive orifice which is adjacent the pre-mixing chamber.

9. The spark ignited burner of claim 1, wherein the pre-mixing chamber has fluted inner walls.

10. The spark ignited burner of claim 1, wherein the burner tip includes a flame retention cup that extends beyond the annular ignition spark discharge gap.

11. The spark ignited burner of claim 10, wherein the flame retention cup extends beyond the annular ignition spark discharge gap in a radial and an axial direction.

12. The spark ignited burner of claim 1, wherein the burner nozzle and the burner tip are electrically insulated from one another.

13. The spark ignited burner of claim 12, wherein the burner nozzle and the burner tip are electrically insulated from one another by at least one insulating spacer provided in the annular space therebetween.

14. The spark ignited burner of claim 12, further including an electrode which passes through said first housing and is in contact with the first tubular member.

15. The spark ignited burner of claim 1, wherein the means for introducing a primary air flow includes a first housing through which the first tubular member extends and from which the second tubular member extends.

16. The spark ignited burner of claim 15, wherein, the first housing includes a chamber which is in fluid communication with the annular space between the first and second tubular members.

17. The spark ignited burner of claim 15, wherein the first end of the first tubular member is attached to the first housing member by at least one electrical insulating element.

18. The spark ignited burner of claim 17, wherein the first end of the first tubular member is attached to the first housing member by a plurality of electrical insulating elements and a mechanical fastener.

19. The spark ignited burner of claim 1, further comprising a second housing defining an annular chamber which surrounds at least a portion of the second tubular member; and means for introducing a main air flow through the annular chamber.

20. The spark ignited burner of claim 19, further comprising means within said second housing for diverting and directing the main air flow.

21. The spark ignited burner of claim 1, further including an electrode in contact with said first tubular member.

22. The spark ignited burner of claim 1 in combination with a radiant tube.

23. A spark ignited burner which comprises:

a first tubular member having first and second ends;

a second tubular member having first and second ends, the second tubular member surrounding and being coaxial with the first tubular member so as to define an annular space therebetween;

means for introducing a fuel gas through the first tubular member;

means for introducing a primary air flow through the annular space between the first and second tubular members; and a burner tip assembly attached to the second ends of the first and second tubular members, said burner tip assembly comprising:

a burner nozzle in fluid communication with the second end of the first tubular member; and a burner tip surrounding the burner nozzle and defining an annular space therebetween, the burner tip being in fluid communication with said first tubular member and having a radially inward directed structure which defines an annular ignition spark discharge gap between the burner nozzle and the burner tip.

24. The spark ignited burner of claim 23, further comprising a pre-mixing chamber defined within the annular space between the burner nozzle and the burner tip.

25. The spark ignited burner of claim 23, wherein the burner nozzle includes a restrictive orifice which is adjacent the pre-mixing chamber.

26. The spark ignited burner of claim 23, wherein the pre-mixing chamber has fluted inner walls.

27. The spark ignited burner of claim 23, wherein the burner tip includes a flame retention cup that extends beyond the ignition spark discharge gap.

28. The spark ignited burner of claim 27, wherein the flame retention cup extends beyond the ignition spark discharge gap in a radial and an axial direction.

29. The spark ignited burner of claim 28, wherein the burner nozzle and the burner tip are electrically insulated from one another.

30. The spark ignited burner of claim 29, wherein the burner nozzle and the burner tip are electrically insulated from one another by at least one insulating spacer provided in the annular space therebetween.

31. The spark ignited burner of claim 23, wherein the means for introducing a primary air flow includes a first housing through which the first tubular member extends and from which the second tubular member extends.

32. The spark ignited burner of claim 31, wherein the first housing includes a chamber which is in fluid communication with the annular space between the first and second tubular members.

33. The spark ignited burner of claim 31, wherein the first end of the first tubular member is attached to the first housing member by at least one electrical insulating element.

34. The spark ignited burner of claim 33, wherein the first end of the first tubular member is attached to the first housing member by a plurality of electrical insulating elements and a mechanical fastener.

35. The spark ignited burner of claim 23, further comprising a second housing defining an annular chamber which surrounds at least a portion of the second tubular member; and means for introducing a main air flow through the annular chamber.

36. The spark ignited burner of claim 30, further comprising means within said second housing for diverting and directing the main air flow.

37. The spark ignited burner of claim 23, further including an electrode in contact with said first tubular member.

38. The spark ignited burner of claim 31, further including an electrode which passes through said first housing and is in contact with the first tubular member.

39. The spark ignited burner of claim 23 in combination with a radiant tube.

* * * * *